US007905846B2

(12) United States Patent
Ganti

(10) Patent No.: US 7,905,846 B2
(45) Date of Patent: Mar. 15, 2011

(54) SPECIAL BED, FOR BEDSORES THERAPY AND MASSAGE THERAPY

(76) Inventor: Sastry K. Ganti, Buffalo Grove, IL (US)

( * ) Notice: Subject to any disclaimer, the term of this patent is extended or adjusted under 35 U.S.C. 154(b) by 986 days.

(21) Appl. No.: 11/449,210

(22) Filed: Jun. 8, 2006

(65) Prior Publication Data

US 2007/0083134 A1 Apr. 12, 2007

Related U.S. Application Data

(60) Provisional application No. 60/724,100, filed on Oct. 6, 2005.

(51) Int. Cl.
*A61H 1/00* (2006.01)

(52) U.S. Cl. ..... 601/26; 601/98; 601/101; 601/103

(58) Field of Classification Search ..... 601/98, 601/49, 23, 24, 26, 39, 97, 101, 103, 143–147; 5/600, 619, 934; 128/845
See application file for complete search history.

(56) References Cited

U.S. PATENT DOCUMENTS 4,373,516 A 2/1983 Masuda
4,412,534 A 11/1983 Hamabe
4,656,998 A 4/1987 Masuda
4,958,627 A 9/1990 Park
5,109,558 A 5/1992 Di Blasi
5,501,658 A 3/1996 Frye
5,820,573 A 10/1998 Ramos
6,799,342 B1 10/2004 Jarmon
7,467,426 B1 * 12/2008 Jarmon et al. ..... 5/191
2004/0215113 A1 * 10/2004 Saringer ..... 601/90

* cited by examiner

*Primary Examiner* — Loan Thanh
*Assistant Examiner* — Valerie Skorupa

(57) ABSTRACT

A specialized bed is described, FIGS. 2 and 3, that will prevent bedsores, heal existing bedsores, with no repositioning of patient required. With modifications it will be an effective massager, FIGS. 14 and 15. The following is a description for Bedsores Therapy. The electro-mechanically powered bed, designed for resting of a living body that has limited or no capability of motion by self, has its resting area composed of movable Bed Elements, FIGS. 5 and 6. The sequential lowering of these Bed Elements from contact with the body for sufficient length of time reestablishes blood circulation near skin in the regions that had been starved of blood. Down and up motion of the Bed Elements is created by Gear Motor Drive 30 which rotates two Camshaft assemblies 28L and 28R. A series of Cams 82, arranged with gradual phase shift, give the down and up movements to the Bed Elements in a desired sequential and cyclical manner.

1 Claim, 11 Drawing Sheets

SPECIAL BED, FOR BEDSORES THERAPY AND MASSAGE THERAPY

CROSS-REFERENCE TO RELATED APPLICATION

Figure 1X:
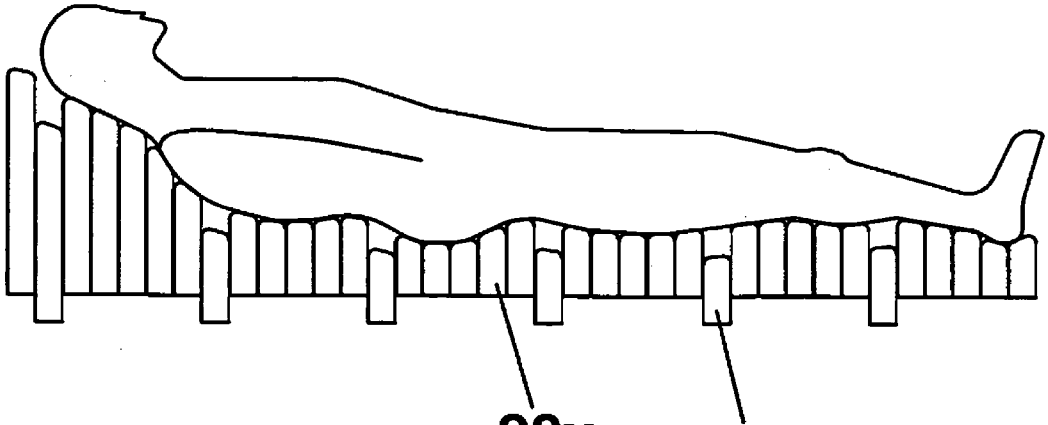

This application claims the benefit of provisional patent application, Ser. No. 60/724,100, filed 2005 Oct. 6, confirmation number 4379, by the present inventor.

FEDERALLY SPONSORED RESEARCH

Not applicable

SEQUENCE LISTING OR PROGRAM

Not Applicable

BACKGROUND OF THE INVENTION, —FIELD OF INVENTION

This invention relates to special bed apparatuses and concepts for Bedsores. Therapy, for anyone susceptible to bedsores due to limited or no mobility, and to apparatuses incorporating similar concepts for use by anyone for Massage Therapy.

BACKGROUND OF THE INVENTION, PRIOR ART

Bedsores Therapy: Any living body, that rests motionless because of limited or no mobility and can not change position without help, is at high risk of bedsores. Bedsores can develop in a matter of hours and may worsen to deep pressure ulcers. A pressure ulcer is an injury caused by prolonged pinch pressure and shearing forces to the skin and nearby muscles. Their severity ranges from mild, affecting the skin surface only, to severe when deep ulcers reach down to muscle and bone. Prolonged pinch pressure closes tiny blood vessels that nourish and supply oxygen to cells at and near the skin. When these cells lack nutrients and oxygen for prolonged periods, the tissue they are a part of dies, and bedsores form. The prior art of treating the described problems is limited to frequent inspection of the patient, increased frequency of bathing and wound dressing, medication, control of the environmental factors, et cetera. To prevent new bedsores from appearing, proper body positioning and frequent changing of body position is done so that no area of the skin bears the pinch pressure against the resting surface for prolonged periods. Devices used to lessen pinch pressure are pillows, fluidized mattresses, foam wedges, doughnut shaped cushions, et cetera. These devices spread the body weight over a larger pinch pressure area thereby lessening the unit pinch pressure, or shift body weight to new pinch pressure areas. However, they never really reduce the pinch pressure below the threshold required for the blood to flow freely and frequently to the cells of the body at the pinch pressured areas. Additionally, the body has to be repositioned frequently, generally requiring manual lifting of at least a portion of the body mass. Hence, frequent disturbance of the patient is normal.

Summarizing the deficiencies in the prior art: With prior art the living body with limited or no mobility still needs to be frequently repositioned, irrespective of products and devices available, and such attention results in lifting at least a portion of the body's mass, thus disturbing the patient in the process. Any delay or negligence in shifting position of the motionless living body threatens with forming of bedsores.

Massage Therapy: Anyone needing a body massage through a device has a number of inventions available. Most of these use a roller action on the surface of one's body. U.S. Pat. No. 5,501,658 (1996) to Paul E Frye uses a roller mechanism under a massage table to accurately follow the curvature of a patient's back to maintain substantially a constant massaging pressure. U.S. Pat. No. 4,373,516 (1983) to Teruo Masuda, Masayasu Morita, Kazuyuki Yamaguchi, and Yoshikazu Harada involves an apparatus with a number of contoured pressure rollers under a person's body and they are moved on tracks. U.S. Pat. No. 4,656,998 (1987) to Teruo Masuda, and Kichiro Yamaguchi involves a foldable massage bed with reciprocating rollers. U.S. Pat. No. 4,412,534 (1983) to Takafumi Hamabe, and Hiroshi Moriwaki involves a massaging apparatus with a series of massaging wheels on a rotary shaft. U.S. Pat. No. 5,820,573 to Grace Marie Ramos (1998) involves a massage device with a rigid base and rounded top pressure nibs.

Summarizing the deficiencies in the prior art: Practically all prior art addresses applying massage with predominantly shearing forces on the human body using rollers; the person's body shape and body's weight distribution on the massaging rollers having a significant influence on the quality of massage therapy and on the induced massaging forces.

BACKGROUND OF THE INVENTION, OBJECTS AND ADVANTAGES

Accordingly, the objects and advantages of invention presented in my patent application are classified as belonging to three types of similar apparatuses, —all having several advantages over prior art.

Apparatus 1: Provides a resting surface for a living body having limited or no mobility, allowing it to rest for indefinite periods of time without the fear of developing bedsores and without the body being in need of having to be repositioned by others. This apparatus is referred to as 'Bed-A, Bedsores Therapy'

Apparatus 2: Provides a massaging surface using similar concept as of apparatus 1 above, but with variations in some of the mechanical parts and their motions. It can generate impact as well as shear forces for massaging. The body's weight or weight distribution on the apparatus plays very little influence on the quality of massaging. This apparatus is referred to as 'Bed-A, Massage Therapy'

Apparatus 3: This apparatus is similar in concept and function to apparatus 1 with differences in construction and operation. This apparatus is referred to as 'Bed-B, Bedsores Therapy'.

Objects of apparatuses 1 & 3 (Beds A and B, Bedsores Therapy):

First object of apparatuses 1 and 3 is, —to completely relieve pressure on the living body's pinch pressure contact area with resting surface.

Second object of apparatuses 1 and 3 is, —to completely relieve the above mentioned pressure for every new contact area in a sequential manner, since relieving areas of pinch pressure produces a new areas with pinch pressure.

Third object of apparatuses 1 and 3 is, —to achieve the pressure relief, regardless of the position and orientation of the body on resting surface.

Fourth object of apparatuses 1 and 3 is, —to achieve all three objects mentioned above for desirable length of time at desirable intervals, so that the body establishes needed blood circulation at the pinch pressure contact areas.

Fifth object of apparatuses 1 and 3 is, —to maintain the comfort level of the resting body at all times it is resting on the resting surface.

Sixth object of apparatuses 1 and 3 is, —to achieve a situation of nursing routine that is substantially less frequent for the body, in relation to attending to bedsores, and where the patient is disturbed substantially less than by existing routine based on prior art.

Seventh object of apparatuses 1 and 3 is, —to achieve all six objects mentioned above regardless of the size, body mass or shape of the patient or their relative distribution in relation to the whole body.

Summarizing the advantages of the proposed art for apparatuses 1 and 3: For a living body that can not adequately reposition self on own, either apparatus will prevent new bed sores from forming and help in healing existing bedsores while increasing the comfort level of the patient, when compared to prior art.

Objects of Apparatus 2 (Massage Therapy):

First object of apparatus 2 is, —to provide massage to a living body with impact style strokes.

Second object of apparatus 2 is, —to provide massage strokes that are in rapid sequence in close proximity to each other, strokes that somewhat resemble a drummer drumming a drum with sticks.

Third object of apparatus 2 is, —to provide massage strokes whose impact strength is independent of the body mass or its distribution.

Fourth object of apparatus 2 is, —to provide massage to any part of the body at any desired angle, such being achieved by changing the orientation of the body or of the apparatus relative to the other.

Summarizing the advantages of the proposed art for apparatus 2: Massaging is achieved by rapid impact strokes of desired quality on a living body, at any desired location, area and angle with respect to the body, irrespective of the size of the body and its weight distribution.

SUMMARY

In accordance with my invention, an apparatus consists of a surface area for a living body to rest upon, such area being divided into a multitude of small areas, each of which can be moved to-and-fro from the body in a cyclical manner from its normal nominal position, whereby the apparatus can be used as a bed for Bedsore Therapy or a surface for Massage Therapy.

DRAWINGS, FIGURES

FIG. 1*x* Concept drawing, —Bedsores Therapy, Bed-A

Figure 1Y:
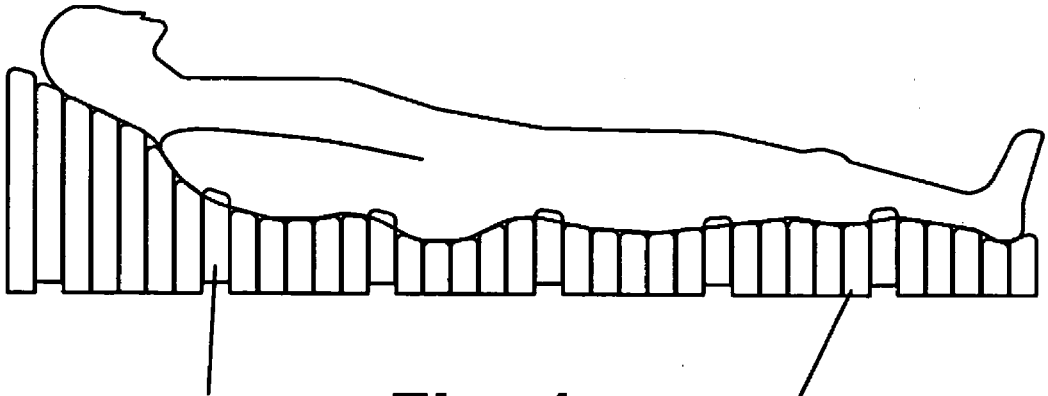

FIG. 1*y* Concept drawing, —Massage Therapy, Bed-A

Figure 2:
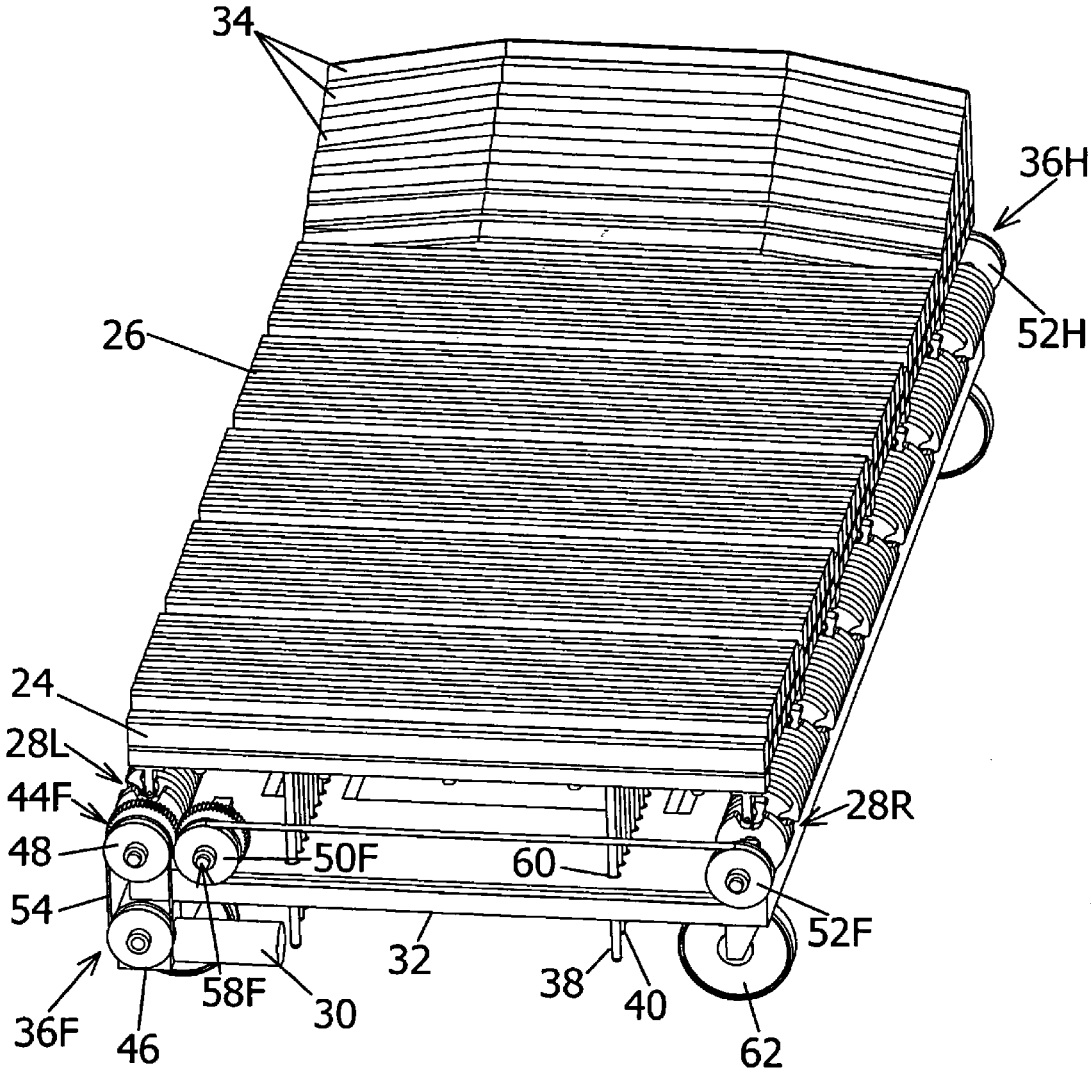

FIG. 2 Bed-A Assembly, viewed from above and feet side, Bedsores Therapy

Figure 3:
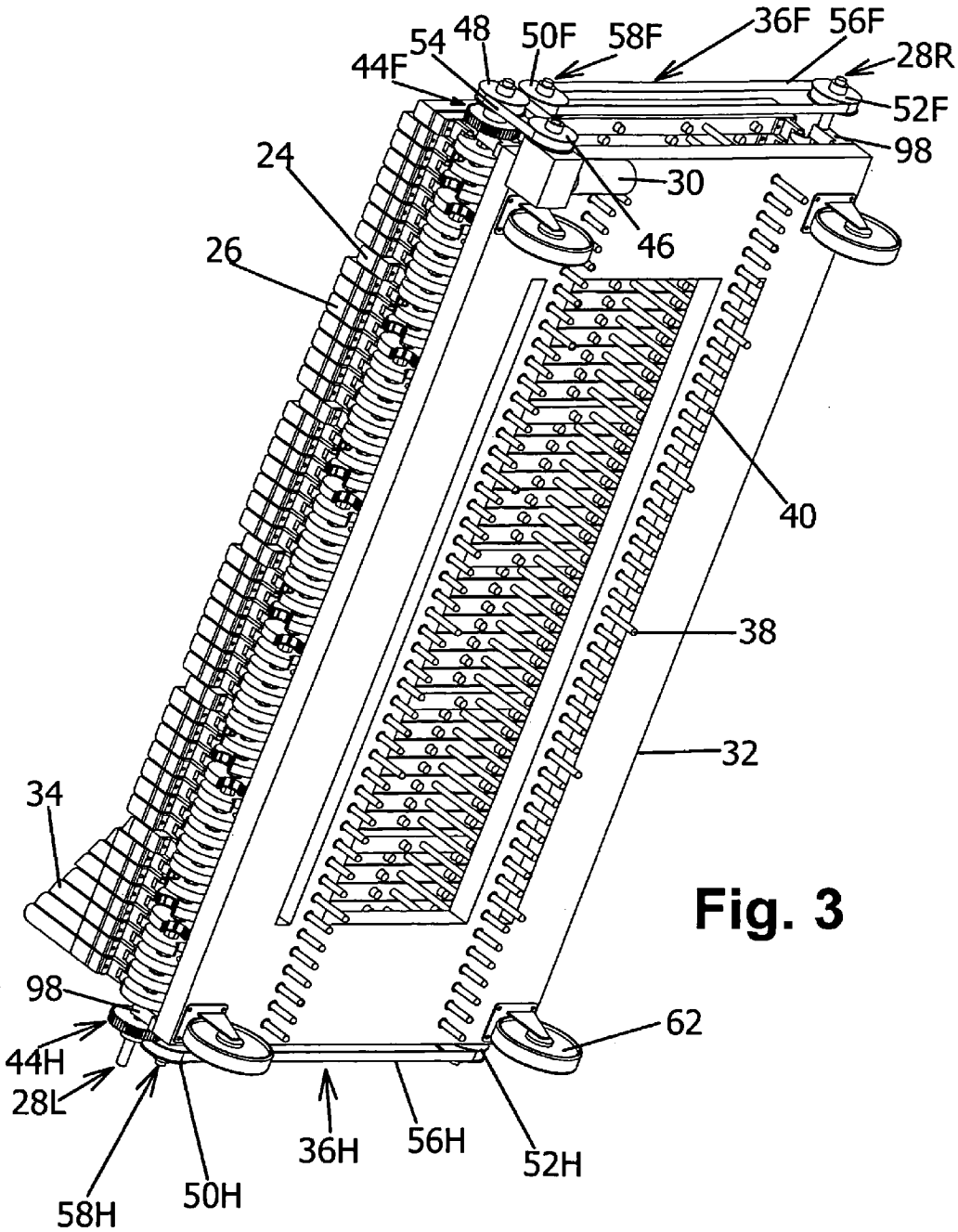

FIG. 3 Bed-A Assembly, Underside View, Bedsores Therapy

Figure 4:
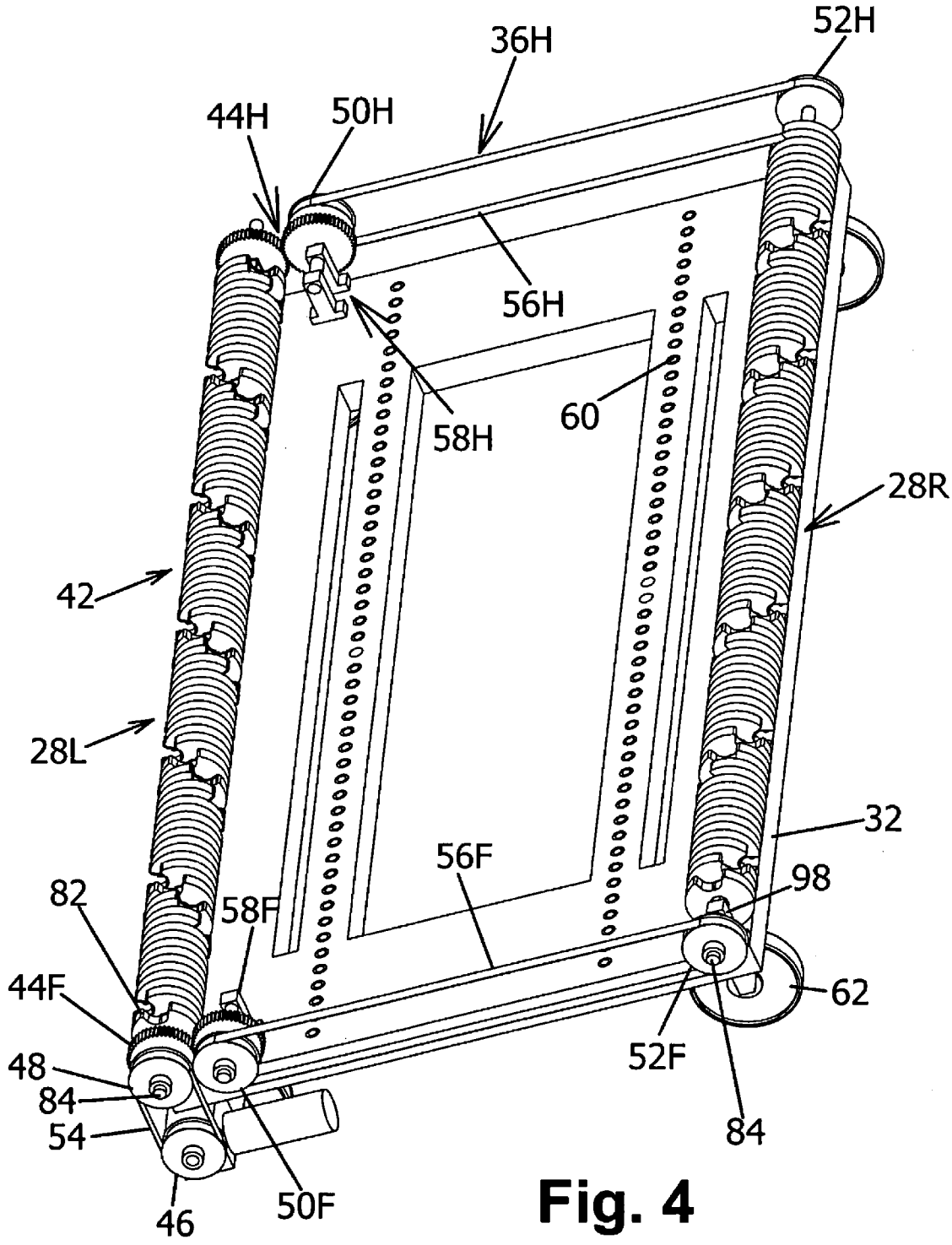

FIG. 4 Frame, drive, cams and cam-shafts Assembly, Bed-A, Bedsores Therapy

Figure 5:
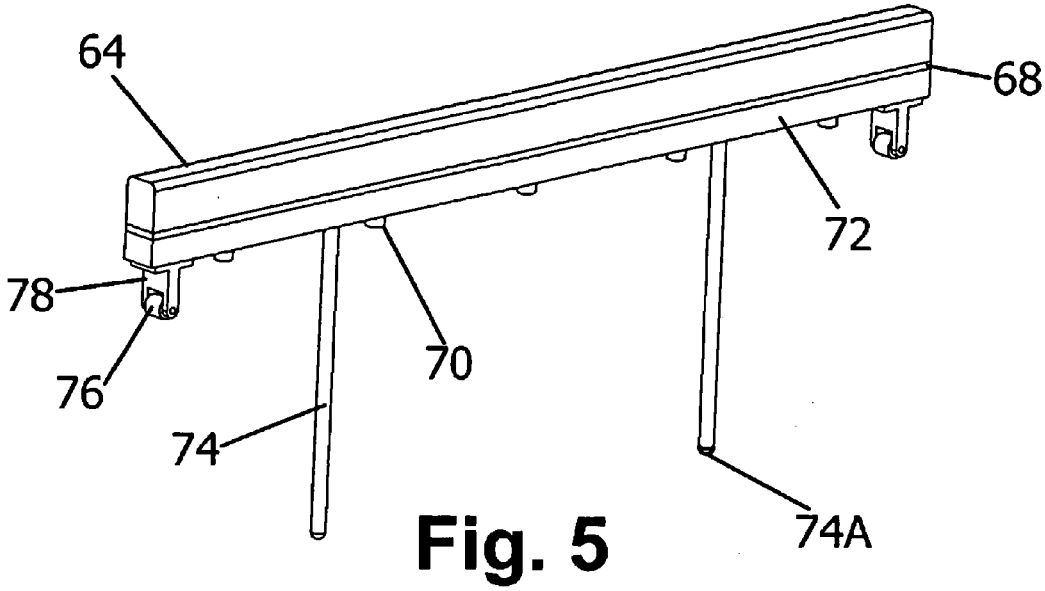

FIG. 5 Bed Element, —with Flat Cushion Liner and Guide Rods, Bed-A

Figure 6:
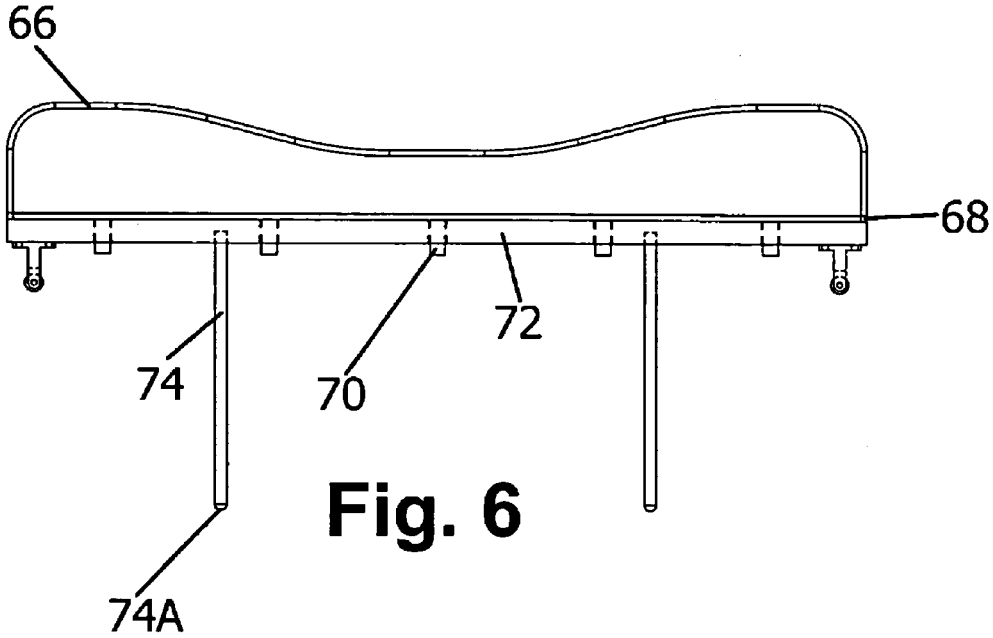

FIG. 6 Bed Element, —with Contoured Cushion Liner and Guide Rods, Bed-A

Figure 7:
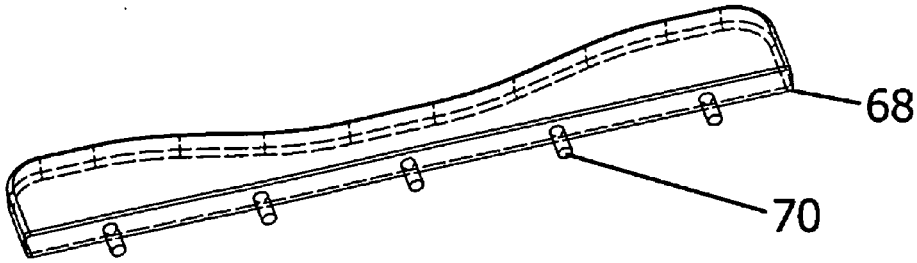

FIG. 7 Contoured Cushion Liner, —on Support Strip with Pegs, Bed-A

Figure 8:
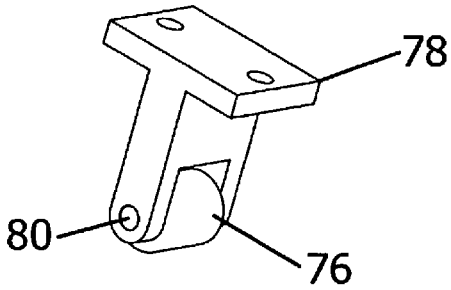

FIG. 8 Cam Follower Bracket Assembly, Bed-A

Figure 9:
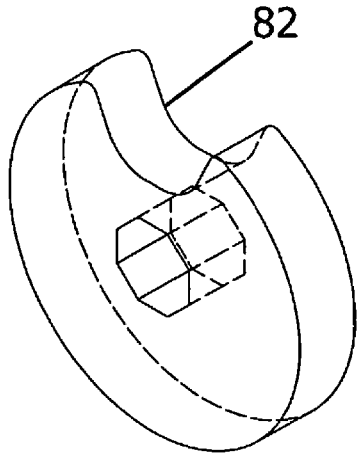

FIG. 9 Cam, —Bed Element withdrawing type, Bed-A, Bedsores Therapy

Figure 10:
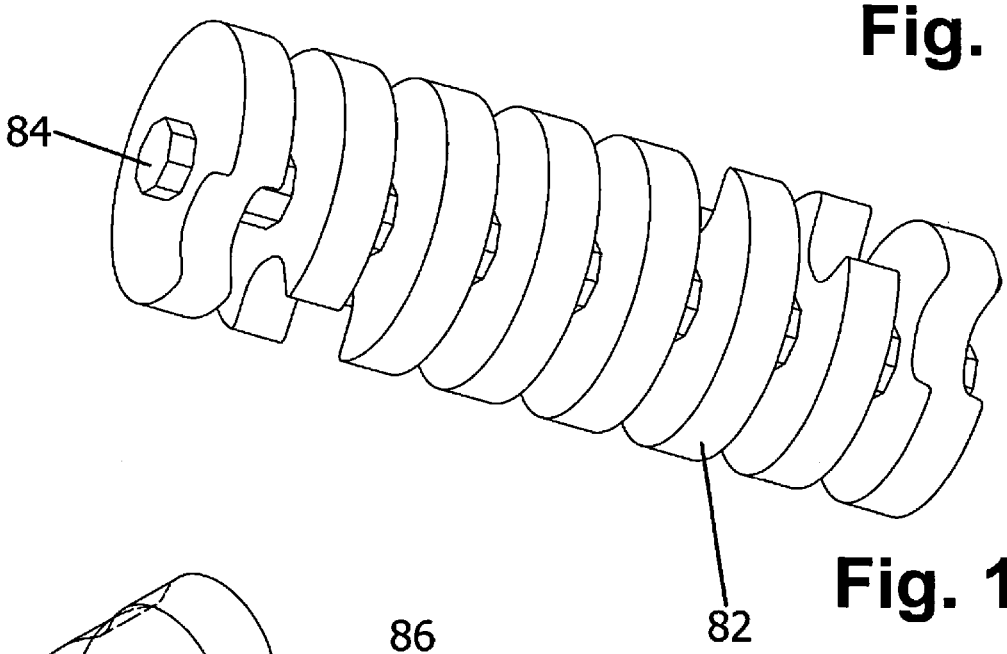

FIG. 10 Partial Cam Shaft Assembly, Bed A, Bedsores Therapy

Figure 11:
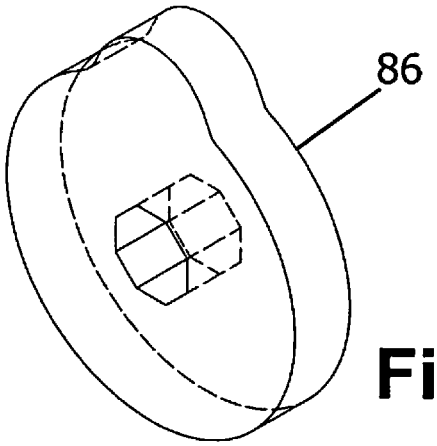

FIG. 11 Cam, —Bed Element advancing type, Bed A, Massage Therapy

Figure 12:
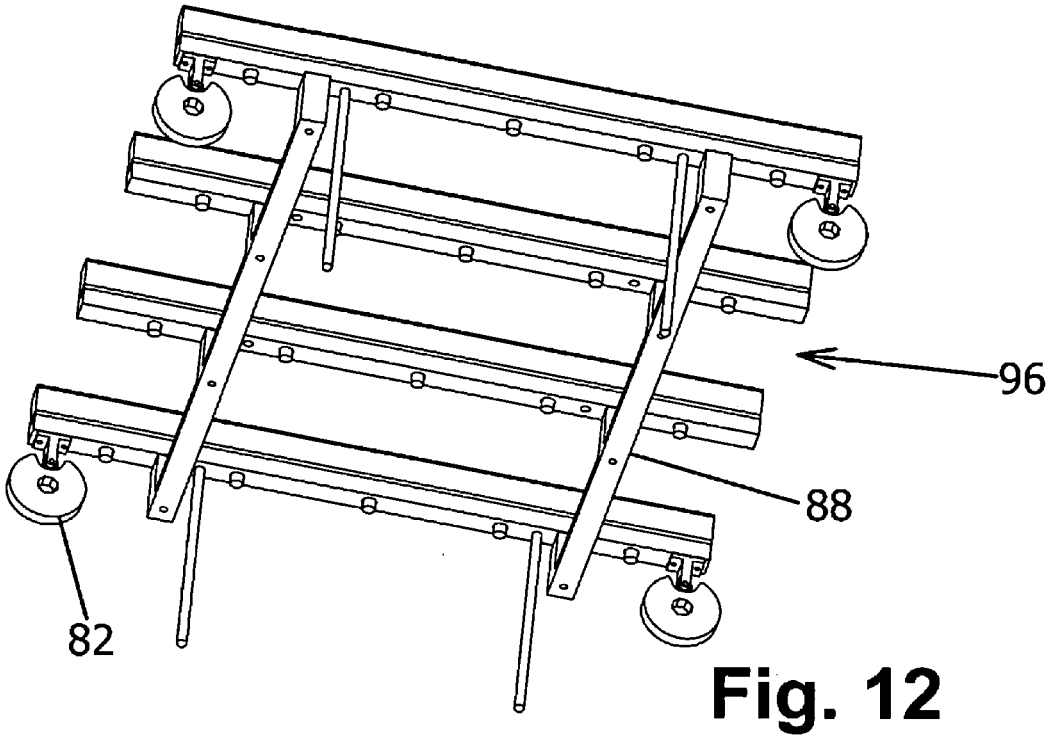

FIG. 12 Unitized Bed Element, underside view, Bed-A, Bedsores Therapy

Figure 13:
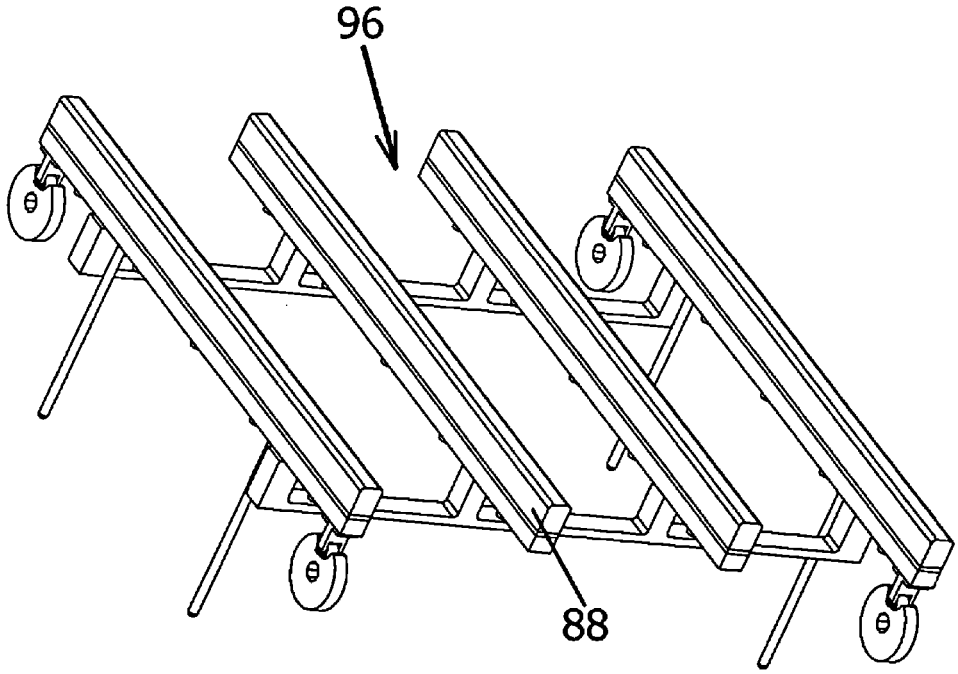

FIG. 13 Unitized Bed Element, view from above, Bed-A, Bedsores Therapy

Figure 14:
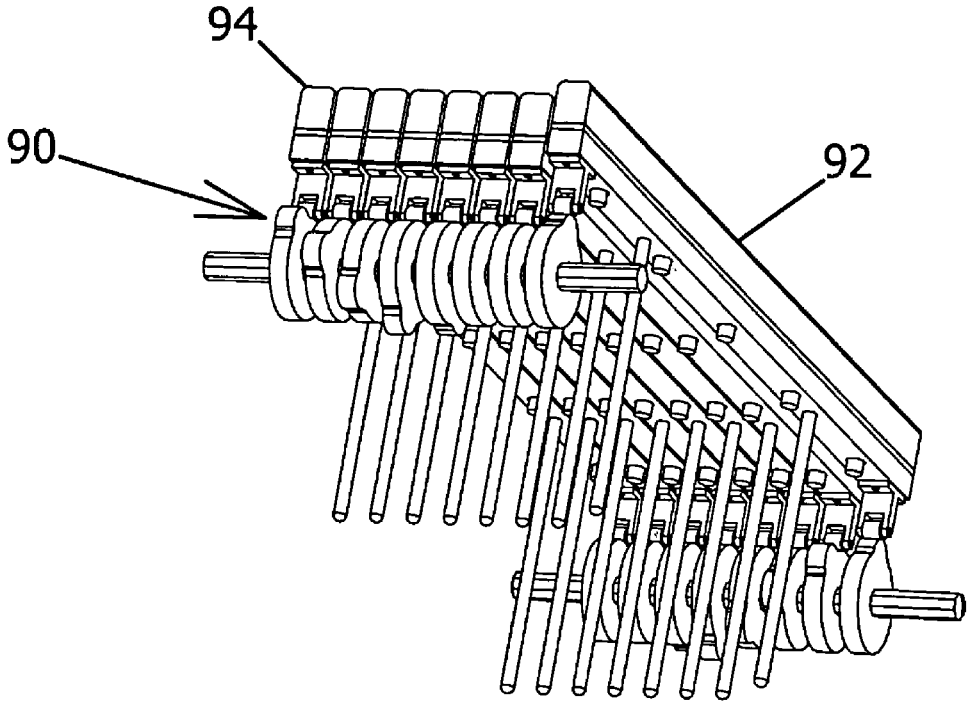

FIG. 14 Partial Assembly of Bed A, Massage Therapy, underside view

Figure 15:
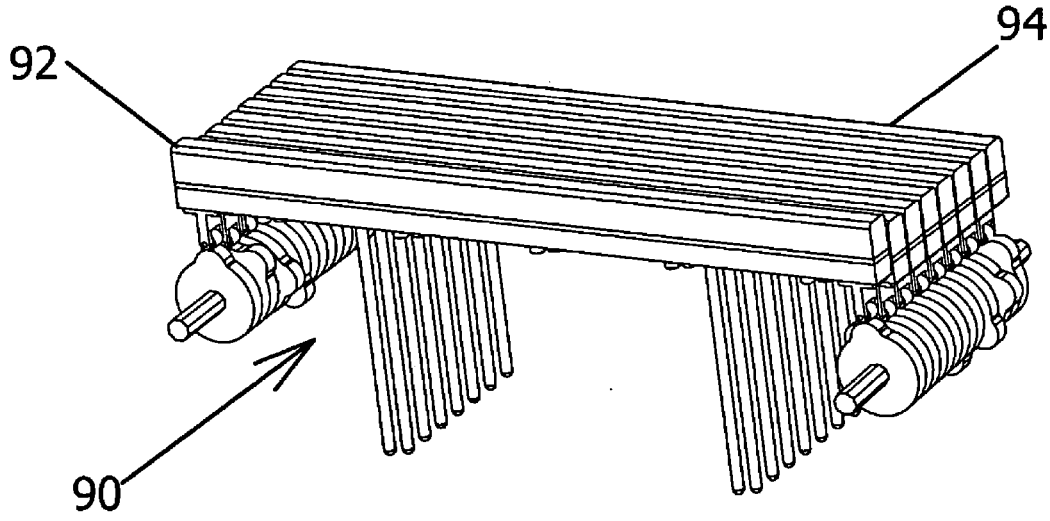

FIG. 15 Partial Assembly of Bed A, Massage Therapy, view from above

Figure 16:
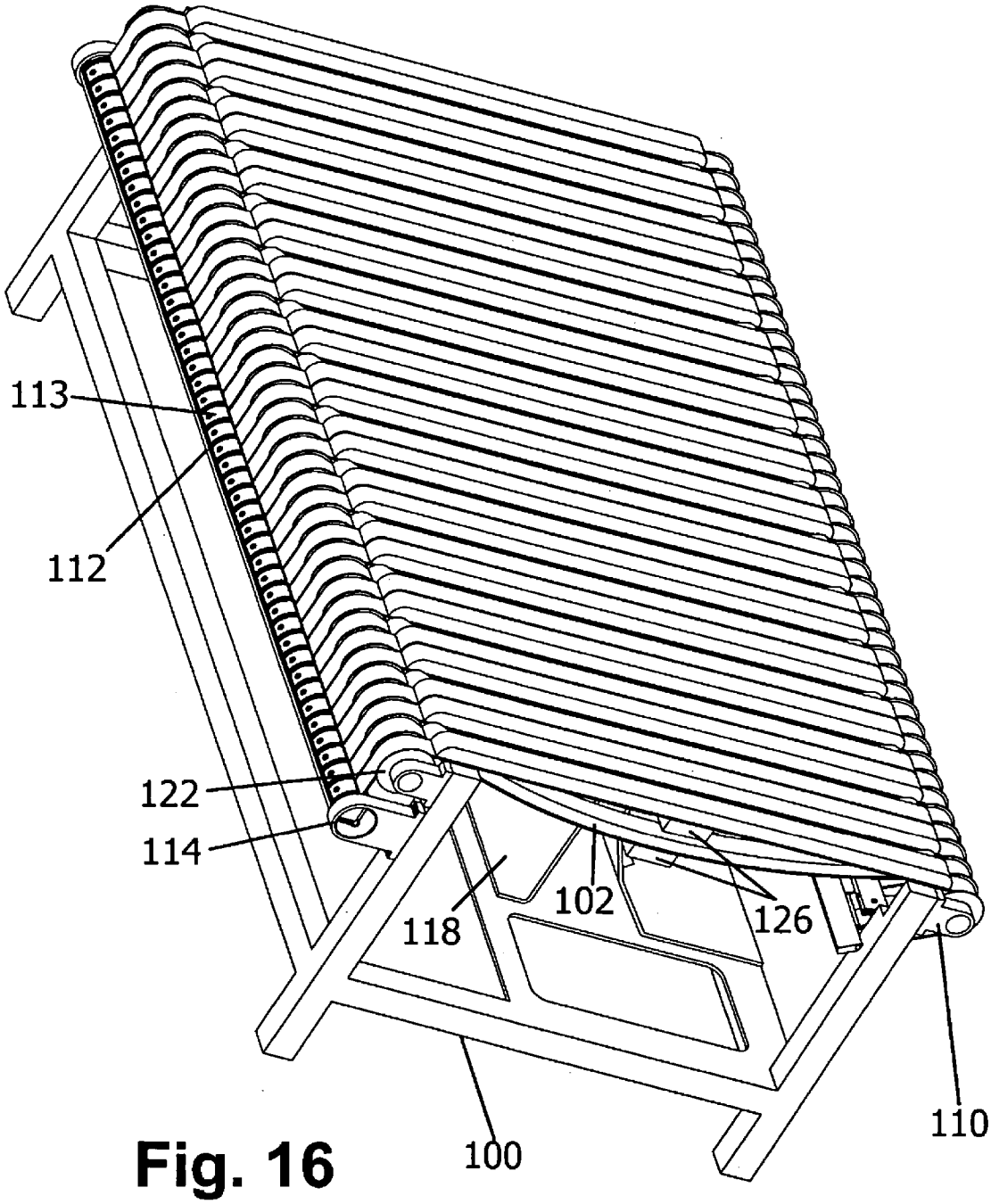

FIG. 16 Bed-B with Flexible Strips, Bedsores Therapy, view from above

Figure 17:
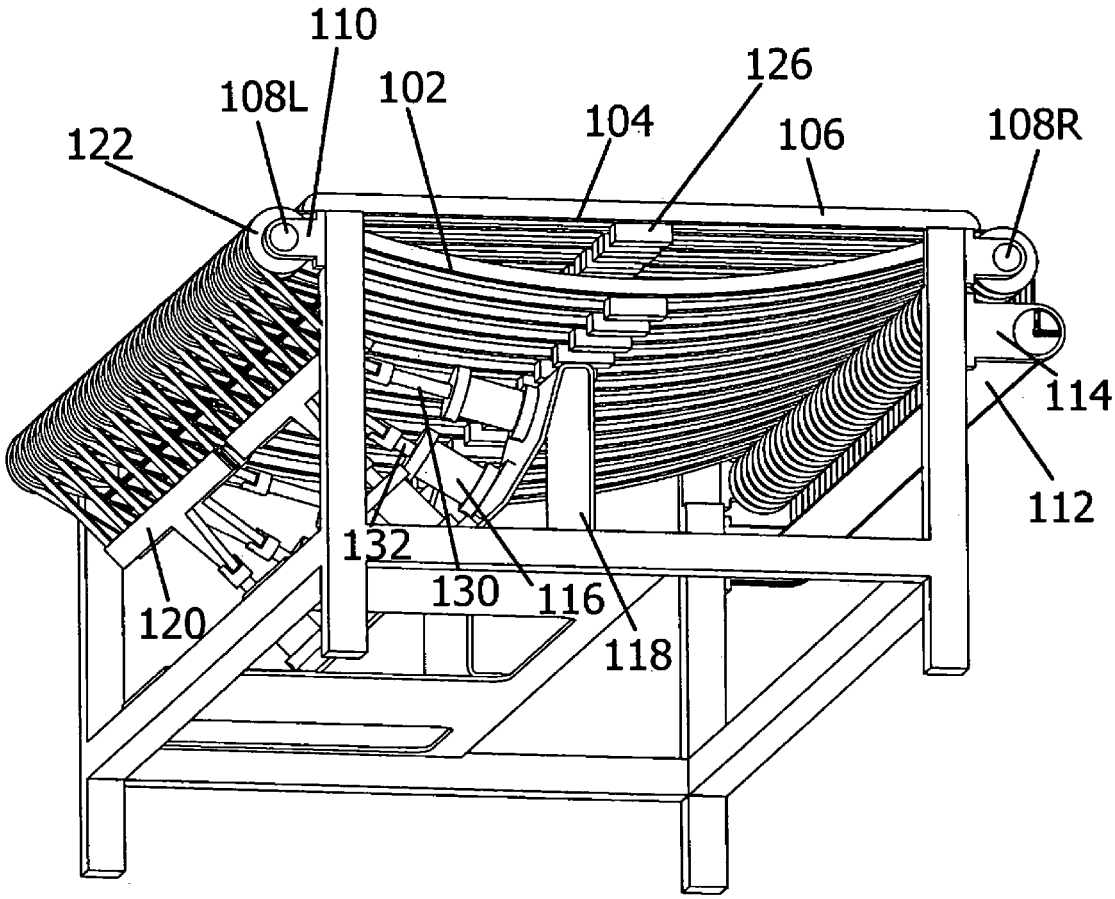

FIG. 17 Bed-B with Flexible Strips, Bedsores Therapy, underside view

Figure 18:
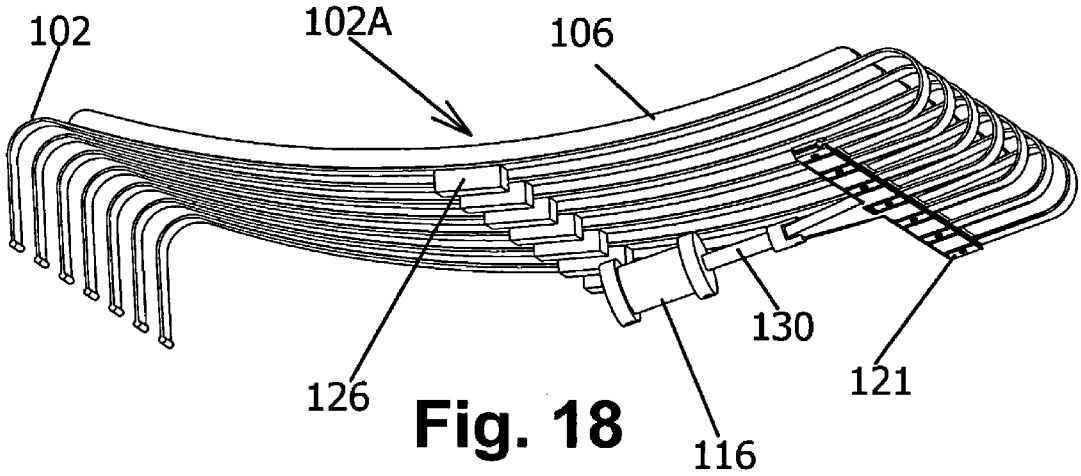
Figure 19:
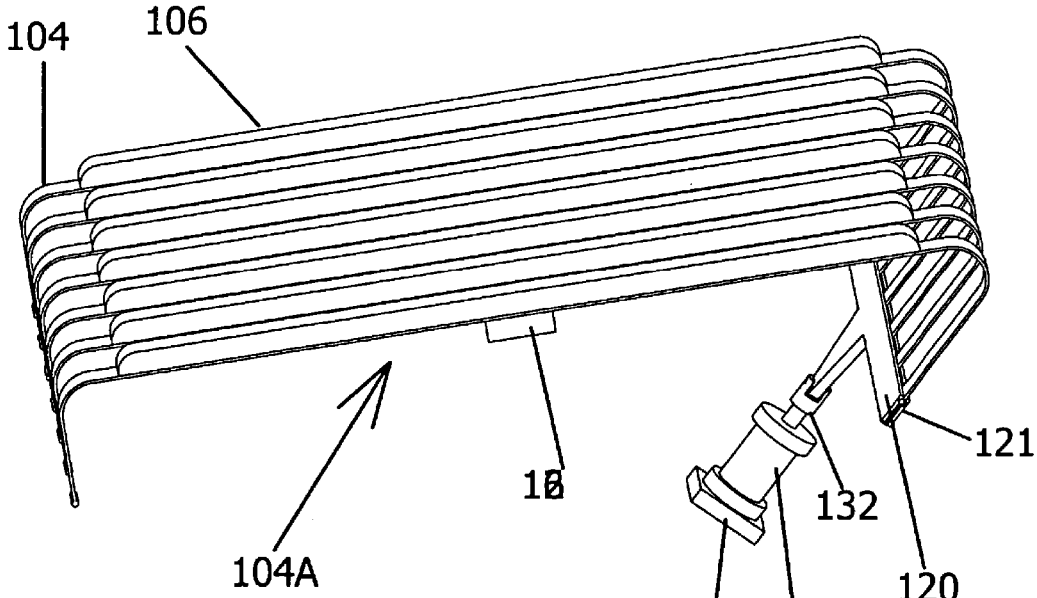

FIG. 18 Flexible Strips Module, —relaxed and sagged, Bed-B, Bedsores Therapy FIG. 19 Flexible Strips Module, —pulled and taut, Bed-B, Bedsores Therapy

DRAWINGS, REFERENCE NUMERALS

20*x* Concept Bed Element, —at normal nominal position, Bed-A, Bedsores Therapy
20*y* Concept Bed Element, —at normal nominal position, Bed-A, Massage Therapy
22*x* Concept Bed Element, —at withdrawn position, Bed-A, Bedsores Therapy
22*y* Concept Bed Element, —at advanced position, Bed-A, Massage Therapy
24 Bed Element—at withdrawn position, Bed-A, Bedsores Therapy
26 Bed Element—at normal nominal position, Bed-A, Bedsores Therapy
28R Right Cam-shaft Assembly, Bed-A, Bedsores Therapy
28L Left Cam-shaft Assembly, Bed-A, Bedsores Therapy
30 Gear Motor, Bed-A
32 Bed Frame—with Casters and Bushed Holes, Bed-A
34 Bed Elements—at Head Side, Bed-A
36F Drive Assembly with Gear Motor—at Feet Side, Bed-A
36H Drive Assembly—at Head Side, Bed-A
38 Guide Rod—at withdrawn Bed Element, Bed-A, Bedsores Therapy
40 Guide Rod—at normal nominal position, Bed-A, Bedsores Therapy
44F Gear Pair at Feet Side, Bed-A
44H Gear Pair at Head Side, Bed-A
46 Pulley at Gearmotor, Bed-A
48 Pulley at Left Camshaft, Feet Side, Bed-A
50F Pulley at intermediate axle, Feet Side, Bed-A
50H Pulley at intermediate axle, Head Side, Bed-A
52F Pulley at Right Cam-shaft Feet Side, Bed-A
52H Pulley at Right Cam-shaft Head Side, Bed-A
54 Belt at Gearmotor, Bed-A
56F Belt, Power Takeoff to Right Cam-shaft Feet Side, Bed-A
56H Belt, Power Takeoff to Right Cam-shaft Head Side, Bed-A
58F Intermediate Axle and Pillow Blocks, Feet Side, Bed-A
58H Intermediate Axle and Pillow Blocks, Head Side, Bed-A
60 Bushed Hole in Frame for Guide Rod, Bed-A
62 Caster, Bed-A
64 Flat Liner Cushion, Bed-A
66 Contoured Liner Cushion, Bed-A
68 Support Strip at Liner Cushion, Bed-A
70 Peg at Support Strip, Bed-A
72 Support Bar at Support Strip, Bed-A

74 Guide Rod, Bed A
74A Rounded end at Guide Rod, Bed-A
76 Cam-roll, Bed-A
78 Yoke Bracket, Bed-A
80 Axle at Cam-roll, Bed-A
82 Cam, Bed Element withdrawing type, Bed-A, Bedsores Therapy
84 Cam Shaft—showing octagonal drive section, Bed-A, Bedsores Therapy
86 Cam, Bed Element Advancing Type, Bed-A, Massage Therapy
88 Connector Bar of Bed Elements, Bed-A, Bedsores Therapy
90 Partial Assembly, Cams, Cam-shafts, Bed Elements—Bed-A, Massage Therapy
92 Advanced Bed Element, Bed-A, Massage Therapy
94 Bed element in normal nominal position, Bed-A, Massage Therapy
96 Unitized Bed Elements' Assembly, Bed-A, Bedsores Therapy
98 Pillow Block, Cam Shaft, Bed-A
100 Bed Frame, Bed-B, Bedsores Therapy
102 Relaxed and Sagged Strip, Bed-B, Bedsores Therapy
102A Group Module, Relaxed and Sagged, Bed-B, Bedsores Therapy
104 Pulled and Taut Strip—Typical, Bed-B, Bedsores Therapy
104A Group Module, Pulled and taut, Bed-B, Bedsores Therapy
106 Easily removable Cushion Strip, Bed-B, Bedsores Therapy
108L Pulley Axle Left, Bed-B, Bedsores Therapy
108R Pulley Axle Right, Bed-B, Bedsores Therapy
110 Pillow Block, at Pulley Axle, Bed-B, Bedsores Therapy
112 Anchor Rod for Strips' fixed end, Bed-B, Bedsores Therapy
113 Strip Clamp at Anchor Rod, Bed-B, Bedsores Therapy
114 Pillow Block, at Anchor Rod for Strips, Bed-B, Bedsores Therapy
116 Cylinder—Typical, at Group Module, Bed-B, Bedsores Therapy
118 Cylinder Mounting Bracket, Bed-B, Bedsores Therapy
120 Strip Connector at Cylinder, Bed-B, Bedsores Therapy
121 Strip Clamp at Strip Connector, Bed-B, Bedsores Therapy
122 Flanged Pulley, as Strip guide, Bed-B, Bedsores Therapy
126 Weight, to sag Relaxed Strip, Bed-B, Bedsores Therapy
128 Spacer Block-Shim, at Cylinder, Bed-B, Bedsores Therapy
130 Extended Piston, to relax and sag strips, Bed-B, Bedsores Therapy
132 Retracted Piston —Typical, to tighten Group Module, Bed-B, Bedsores Therapy

DETAILED DESCRIPTION, PREFERRED EMBODIMENT, BED-A BEDSORES THERAPY

The preferred embodiment of present invention, a special bed for people with limited or no mobility, is described as 'Bed-A, Bedsores Therapy'.

The bed's resting surface is comprised of down and up movable sub-assemblies termed as 'Bed Elements'. This is illustrated conceptually in FIG. 1*x*. The conceptual figure points out to a conceptual Bed Element 20*x* that is withdrawn (lowered) and a conceptual Bed Element 22*x* that is in normal nominal position. In FIG. 2 the bed's view is from above. FIG. 3 is an underside view. Bed Element 24 is shown at lowered (withdrawn) position whereas 26 is shown at normal nominal position. Bed-A for Bedsores Therapy, as shown in FIGS. 2 and 3, is equipped with numerous Bed Elements whose details are shown in FIGS. 5 and 6. These Bed Elements are lowered (withdrawn), and raised back to their normal nominal positions by means of Cams 82 (FIG. 9).

FIGS. 7 and 8 show sub-assemblies of some parts that make up a Bed Element, which in itself is a sub-assembly. Thus, referring to FIGS. 5, 6, 7 and 8, a typical Bed Element consists of Flat 64 or Contoured 66 Cushion Liner, Support Strip 68, Pegs 70, Support Bar 72, Guide Rods 74, Cam Followers 76, Yoke Brackets 78, Axles 80. FIG. 3 illustrates Guide Rod 40 in normal nominal position and Guide Rod 38 in lowered (withdrawn) position.

Bed Elements with a variety of Cushion Liners occupy a fractional portion, or the entire portion of the resting surface of the bed. FIG. 10 shows a partial section of a Cam Shaft 84 with a series of Cams assembled, on which the Cam Followers will rest with mutual and constant contact. FIGS. 12 and 13 show how multiple Bed Elements may be rigidly joined using connector bars 88, to form 96, a Unitized Bed Element Assembly. With such design several Bed Elements will move in unison as a single unit. It will lessen the number of cams needed.

FIG. 4 shows an upper view of the Bed-A for Bedsores Therapy, —with all Bed Elements removed, revealing the rest of the bed's parts. Referring to FIGS. 2, 3 & 4 the two Cam Shaft Assemblies are 28L and 28R. Each Cam Shaft 84 is assembled with equal number of Cams 82 that have been given arbitrarily identical profiles, for convenience of illustration only. The Cam Shaft Assemblies are mirror images of each other when viewed from either end of the bed. They rotate in opposite directions. The Cams on each shaft are shown assembled with progressive phase shift of 45 degrees, arbitrarily, on octagonal drive shafts FIG. 10. Any cam on one shaft is shown, again arbitrarily, as a mirror image of the corresponding cam on the other shaft.

The Cam Shafts are powered by Gearmotor Drive Assembly 36F. It is arbitrarily shown at feet side of bed. Similarly the Slave Drive Assembly 36H is shown at the head side of bed. Both drives contain similar parts, namely Pulleys at right side 52F and 52H, Power Takeoff Belts 56F and 56H, Intermediate Axle and Pillow Block Assemblies 58F and 58H, Gear Pairs 44F and 44H. The Intermediate Axles carry the Intermediate Pulleys 50F and 50H. The feet side drive is the primary power supplier containing Gearmotor 30, Pulleys 46 and 48, and Belt 54. FIG. 4 shows Gear Pairs 44H and 44F, whose function, other than transmission of power is reversing rotational directions of Cam shafts.

Bed Frame 32 with Casters 62 houses Bushed Holes 60 for Guide Rods 74. The ends of Guide Rods are rounded 74A, for ease of insertion and removal of Bed Elements. The Bed Elements at Head Side 34, may have Cushions Liners that have progressively pronounced elevations to give the shape of a pillow.

Operation of Special Bed, Preferred Embodiment, Bed-A, Bedsores Therapy:

The patient with limited or no mobility is comfortably positioned on the resting surface of the Bed Elements directly. Items such as bed sheets, cushions, et cetera are not expected to be used between the patient and the bed, especially at the pinch pressure regions of resting, where the patient's mobility is severely limited.

At any given instant, even when the Gearmotor is off, a few of the Bed Elements will be in withdrawn position; that is, the patient's body will not be in contact with the Cushion Liners of these Bed Elements. When the Gearmotor is turned on, immediately the Camshafts are set into rotation. The Gear Pairs make the two shafts rotate in opposite directions, and the rotational speed is expected to be very slow. Such opposite rotations negates to zero, any horizontal components of forces generated at Cam Followers. Thus the Guide Rods are not subjected to any unbalanced bending forces due to the mechanical drive. The rotation of the Cam Shafts begins to withdraw (lower) a set of Bed Elements while returning the already fully withdrawn Bed Elements to their normal nominal positions. The remainder of Bed Elements remain at normal nominal positions, since their Cam followers are riding on the dwell portions of respective Cams. These dwell positions for any Bed Element represent for the body, support positions. At any given instance, only a small fraction of Bed Elements are in withdrawn (lowered) position, thereby the patient does not feel any discomfort of not being fully supported.

Described in a different way, the resting body's pinched areas of contact are relieved of all pressures at every contact region, a fractional region at a time, in a cyclical manner for desired durations, by lowering the corresponding fractional number at a time the respective Bed Elements, while bringing to or maintaining at normal nominal positions all other Bed Elements. Thus, the patients blood circulation at skin level at any pinch pressure region is never blocked for prolonged periods. New bedsores will not develop and existing ones may start healing on their own. The patient will not need frequent repositioning and attentiveness and thus is not disturbed.

Every Bed Element is designed for easy removal and replacement. Each Cushion Liner can be easily peeled off and replaced with new ones. Bed Elements can be easily removed and replaced. Any or all parts of the bed may be easily cleaned and sanitized, especially after removing off the Bed Elements.

Description and Operation, 1$^{st}$ Alternative Embodiment, Bed-A, Massage Therapy:

This embodiment is conceptually shown in FIG. 1*y*. 20*y* is a conceptual Bed Element that is advanced (raised) toward one's body. 22*y* is a conceptual Bed Element that is shown at its normal nominal position.

This Bed-A, for Massage Therapy, is substantially same as the one described above for Bedsores Therapy; the most important difference being, it is equipped with Bed Element Advancing type Cams 86 (FIG. 11), and it will operate significantly faster speeds. The consistency of Bed Element parts will be substantially firmer and stronger to suit massaging a living body.

FIGS. 14 and 15 show partial sections of arrangement of Bed Elements' Assembly 90, with Cams on Camshafts. 94 is Bed Element with Flat Liner Cushion that is in normal nominal position; 92 is in advanced position. The Bed Elements in this application need to be retained. That is, they need to be restrained from being taken off the bed without some disassembly, and they must be subjected to pre-loaded external retaining forces, so that they maintain constant contact at Cam and Cam Follower. The restraining mechanism details have not been shown in the figures.

The massaging action on the resting body is achieved by sequential bumps or strikes in rapid succession, at any preferred location of the body. The movements of the Bed Elements will somewhat resemble a drummer drumming the drum rapidly with drumsticks. It is apparent that this apparatus will be operated at high speeds to receive the benefits of impact type massaging with short but rapid strokes.

Description and Operation, 2$^{nd}$ Alternative Embodiment, Bed-B, Bedsores Therapy:

A body with limited or no mobility may also use Bed-B for Bedsores Therapy, which is illustrated in FIG. 16, a view from above, and in FIG. 17, a view from below. The bed elements in this design are made up of Flexible Strip Assemblies that are relaxed to sag 102, or are pulled to become taut and substantially flat 104. Each Flexible Strip Assembly has an easily removable Cushion Strip 106, on which the body can rest directly. The Cushion Strip is backed with Flexible Strip 102 (or 104). Since a Flexible Strip withstands the body weight and it is predominantly in tension, it is made of materials which can withstand large tension loads and frequent flexing.

Each Flexible Strip Assembly is anchored on one side to the bed. Its other side is movable. All Flexible Strips shown FIG. 16, are arbitrarily anchored on the left side, using the Anchor Rod 112. The Anchor Rod is housed in Pillow Blocks 114. Individual Strip Clamps 113 permit positive individual strip anchoring, and easy removal of individual Strip Assemblies for service and replacement. The movable ends of the strips on the right side of the bed are also provided with individual Strip Clamps 121, for the same purposes of easy removal, servicing, and replacement. Each Cushion Strip can be removed easily without removing its Strip Assembly, by peeling it off for cleaning and maintenance.

Each Flexible Strip Assembly is draped over Flanged Pulleys 122, on both sides of the Bed. The flanges of the pulleys keep the strips contained laterally and separated from each other. They are idler pulleys, housed in Pulley Axles 108L and 108R. These axles are fixed to the Bed Frame 100 with Pillow Blocks 110.

FIG. 18 shows a group of Strip Assemblies to form Strip Module 102A. Its strips are in relaxed, sagged position. 106 shows a Relaxed Flexible Strip with Cushion Strip. FIG. 19 shows a another group of Strip Assemblies forming Strip Module 104A. Its Strip Assemblies are taut and substantially flat. The taut Flexible Strips with their Cushion Strips form substantially a horizontal resting surface to support the body. These Strip Assemblies are connected to their own Strip Connector 120. Relaxed Strip Assemblies are assured of sagging and their Cushion Strips assured of releasing contact pressures with the body by the attached Weights 126, on the underside of strips.

The Strip Assemblies of different Strip Modules are interlaced parallel with each other, such that to either side of a Relaxed Strip Assembly (except at the bed end assemblies) will be one or more of taut Strip Assemblies to support the body. This is clearly noticeable in FIG. 16. Each Strip Connector 120, is connected to the piston rod of a fluid Cylinder 116. Extending a Cylinder relaxes its Module's Strip Assemblies. Retracting the same pulls its Strip Assemblies taut. 118 is a typical Mounting Bracket for a Cylinder. Use of Spacer-Shim Block 128 under a Cylinder facilitates adjustment in axial positioning of the Cylinder so that its piston will never 'bottom out' at its cap end, assuring full pull and tensioning of its Strip Assemblies. The Bed Frame 100, houses all the components mentioned.

It can be seen that by sequentially extending and retracting the Cylinders, in a desired order, and for desired durations, every pinched contact area of the resting body is relieved of pinch pressure for the required period, thus restoring blood flow in the body near skin level. Since for Bedsores Therapy the Cylinder actions need not be a rapid process, the motion of Cylinders may be accomplished at a very slow speed, by very gradually bleeding in or out the pressurized fluids through small orifices. This will keep any process noises to a minimum, and the bed very stable. The fluid circuitry is not presented here.

CONCLUSIONS, RAMIFICATIONS, AND SCOPE:

Accordingly the reader will see that the invention presented need not be limited to the described apparatuses and their embodiments. For Bedsores Therapy beds may be designed where the bed comprises of modular assemblies for resting, surface regions that contain small retractable areas instead of strip or bar like Bed Elements. The Bed elements may be at any angle or shape, not necessarily in a horizontal plane. The plane of the resting surface may be inclined or suitably curved. The Bed Elements may be moved to and fro by other means than that described, such as electrical actuators, pivoted levers. For instance the cylinders shown in FIGS. 18 and 19 may be replaced with electro-mechanical gear-motors. The body may rest not on a bed but a chair or similar resting apparatus containing a variety of Bed Elements. For Massage Therapy, massaging modules rather than a complete bed, may be designed with ideas presented here. They may be hand held, or incorporated into apparatuses of a variety of configurations. The massaging action may be directed to any desired part of one's body, at multiple angular orientations. Concepts of mechanisms presented here for Bedsores and Massage Therapy may be combined into a single apparatus of desired configuration, providing both therapies to a single body at different regions of the body.

I claim:

1. A method of directly connected strip pulling for tensioning and of releasing said pulling for relaxing, the ends of a plurality of strips, wherein each one of said strips has two ends, for a bed whose support platform comprises of said plurality of strips grouped into a plurality of groups, wherein each one of said groups comprises a fractional number of said strips, with one end of each one of said plurality of strips fixedly connected to said bed, the method steps comprising:

(a) attaching of the ends opposite to said fixed ends of the strips in a group, for each one of said groups, to a sturdy member, whereby the resultant number of said sturdy members is equal to the number of said groups, (b) attaching of each one of said sturdy members to a linear actuator, whereby the resultant number of said linear actuators is equal to the number of said groups, (c) connecting each one of said linear actuators to said bed, (d) operating said linear actuators in a cyclical manner wherein, (i) a fractional number of said linear actuators move the sturdy members connected to said fractional number of linear actuators and the strips connected to said sturdy members, in the direction that tensions said strips, (ii) the remainder fractional number of said linear actuators move the remainder sturdy members connected to said remainder fractional number of linear actuators and the remainder of strips connected to said remainder sturdy members, in the direction to relax said remainder of strips, (iii) said linear actuators alternate their to and fro movements in a programmed sequence, whereby, a person lying on said bed will be supported at any given moment by the fractional plurality of flexible strips that are in tension;

wherein the linear actuator comprises a fluid cylinder utilized to tension and relax said plurality of strips: wherein the bed further comprises two pulleys as strip supports, one at each end of each strip of said plurality of strips;

wherein said strip's ends are draped over each one of said pulleys to form a body support, for a body on said bed, by said strip when said strip is in tension;

whereby, frictional resistance to the movement of said strip at said strip supports results in rotational movement of said pulleys, and thereby said rotational movement facilitates easier and quicker tensioning of said strip; the support platform further comprising a weight attached to the underside of each one of said strips, whereby upon relaxation of said strip, said weight will facilitate in the sagging of said strip.

* * * * *